US008931468B2

(12) United States Patent
Huang et al.

(10) Patent No.: US 8,931,468 B2
(45) Date of Patent: Jan. 13, 2015

(54) SINGLE/CONTINUOUS FIRING AIR SOFT GUN AND FIRING SWITCH THEREOF

(71) Applicant: Vega Force International Corp., New Taipei (TW)

(72) Inventors: Kuo-Hao Huang, New Taipei (TW); Wei-Hung Chung, New Taipei (TW)

(73) Assignee: Vega Force International Corp., New Tapei (TW)

( * ) Notice: Subject to any disclaimer, the term of this patent is extended or adjusted under 35 U.S.C. 154(b) by 45 days.

(21) Appl. No.: 13/859,858

(22) Filed: Apr. 10, 2013

(65) Prior Publication Data

US 2014/0000578 A1 Jan. 2, 2014

(30) Foreign Application Priority Data

Jun. 27, 2012 (TW) ..... 101212396 U

(51) Int. Cl.
*F41B 11/56* (2013.01)
*F41B 11/70* (2013.01)

(52) U.S. Cl.
CPC ..... *F41B 11/70* (2013.01)
USPC ..... 124/72

(58) Field of Classification Search
CPC ..... F41B 11/70; F41B 11/56; F41B 11/72; F41B 11/62; F41A 33/06; F41A 3/72
USPC ..... 124/71–74, 56
See application file for complete search history.

(56) References Cited

U.S. PATENT DOCUMENTS

| | | | | | |
|---|---|---|---|---|---|
| 5,476,087 | A * | 12/1995 | Kunimoto | ..... | 124/73 |
| 5,477,843 | A * | 12/1995 | Kunimoto | ..... | 124/73 |
| 6,073,620 | A * | 6/2000 | Kunimoto | ..... | 124/74 |
| 6,112,734 | A * | 9/2000 | Kunimoto | ..... | 124/73 |
| 6,158,424 | A * | 12/2000 | Kunimoto | ..... | 124/73 |
| 7,150,276 | B1 * | 12/2006 | Rice | ..... | 124/73 |
| 7,588,023 | B2 * | 9/2009 | Kung et al. | ..... | 124/27 |
| 8,567,380 | B2 * | 10/2013 | Nugent | ..... | 124/65 |
| 2008/0156309 | A1 * | 7/2008 | Kung et al. | ..... | 124/31 |
| 2013/0118465 | A1 * | 5/2013 | Nugent | ..... | 124/65 |

* cited by examiner

*Primary Examiner* — Michael David
(74) *Attorney, Agent, or Firm* — Chun-Ming Shih; HDLS IPR Services

(57) ABSTRACT

In a single/continuous firing air soft gun and a firing switch thereof, the air soft gun includes a gun body and a barrel fixed in the gun body, and the firing switch includes a piston seat and a firing switch device, wherein the piston seat is disposed in the gun body and capable of reciprocally moving in horizontal with respect to the barrel; and the firing switch device is installed on the piston seat, and includes a stop piece and a toggle piece connected with the stop piece, and the stop piece is disposed corresponding to the trigger assembly.

9 Claims, 11 Drawing Sheets

SINGLE/CONTINUOUS FIRING AIR SOFT GUN AND FIRING SWITCH THEREOF

BACKGROUND OF THE INVENTION

1. Field of the Invention

The present invention relates to an air soft gun, especially to a single/continuous firing air soft gun and a firing switch thereof.

2. Description of Related Art

An air soft gun used for firing BB pellets or paintballs is designed with a trigger, a hammer and a firing power for imitating a real gun, so the application has changed from basic firing to stimulating gun battle, thus the air soft gun has been developed to be equipped with full auto continuous firing, instead of single firing.

The switching between the single firing and continuous firing for an air soft gun mostly utilizes a firing switch device, the firing switch device is installed with a stop piece and a toggle piece connected with the stop piece, and the toggle piece is exposed outside the air soft gun for controlling the movement of the stop piece, thereby enabling the stop piece disposed inside the air soft gun to drive the air soft gun to perform single or continuous firing.

However, because the toggle piece is exposed outside the air soft gun, a situation of accidentally touching the toggle piece may occur, which may cause some accidents; moreover, for installing the toggle piece on the gun body of the air soft gun, a notch have to be formed on the gun body, so the production cost is raised and the assembly is more complicated; furthermore, the firing switch device has to be specially designed for a certain type of gun body, so the same firing switch device cannot be applied to various types of gun bodies, thus manufacturers have to stock various types of firing switch devices.

In view of the mentioned disadvantages, the applicant of the present invention has devoted himself for providing a single/continuous firing air soft gun and a firing switch thereof for solving the disadvantages of related art.

SUMMARY OF THE INVENTION

The present invention is to provide a single/continuous firing air soft gun and a firing switch thereof, in which a toggle piece is installed on a piston seat, so the toggle piece is hidden in a gun body instead of being exposed outside the gun body, thereby enhancing the operation safety of air soft gun and achieving the advantages of lowering production cost and simplifying assembly.

Accordingly, the present invention provides a single/continuous firing air soft gun which includes: a gun body, the interior thereof including a barrel and an ejector assembly reciprocally moving in horizontal with respect to the barrel, the ejector assembly including a piston seat; a hammer assembly fixed in the gun body and including a hammer striking corresponding to the piston seat; a trigger assembly pivoted in the gun body and capable of moveably latching the hammer; and a firing switch device installed on the piston seat and including a stop piece and a toggle piece connected with the stop piece, the stop piece being disposed corresponding to the trigger assembly; wherein, when the toggle piece is moved towards a direction, the stop piece drives the trigger assembly to be latched with the hammer, thereby forming the single firing; on the other hand, when trigger assembly and the hammer are separated, the continuous firing is formed.

Accordingly, the present invention provides a firing switch of the single/continuous firing air soft gun, the air soft gun includes a gun body and a barrel fixed in the gun body, and the firing switch includes: a piston seat disposed in the gun body and capable of reciprocally moving in horizontal with respect to the barrel; and a firing switch device installed on the piston seat and including a stop piece and a toggle piece connected with the stop piece, the stop piece being disposed corresponding to the trigger assembly.

In comparison with the related art, the present invention has following advantageous features.

The toggle piece is installed on the piston seat, so the toggle piece is hidden inside the gun body instead of being exposed outside the gun body, thereby enabling to the firing switch device to be prevented from being accidentally touched by the user, so the operation safety of air soft gun is enhanced; meanwhile, the firing switch device provided by the present invention is applicable in various types of gun bodies, and not restrained by the contour of the gun body, thereby achieving the advantages of lowering production cost and simplifying assembly.

Moreover, the stop piece is formed with a notch, and the toggle piece is formed at one side of the stop piece and corresponding to the notch, so the toggle piece is easier to be moved through the notch, thereby simplifying the components of the firing switch device, so the firing switch device of the present invention is provided with the advantages of simplifying assembled components, lowering production cost and easy in assembly.

DETAILED DESCRIPTION OF THE INVENTION

Figure 1:
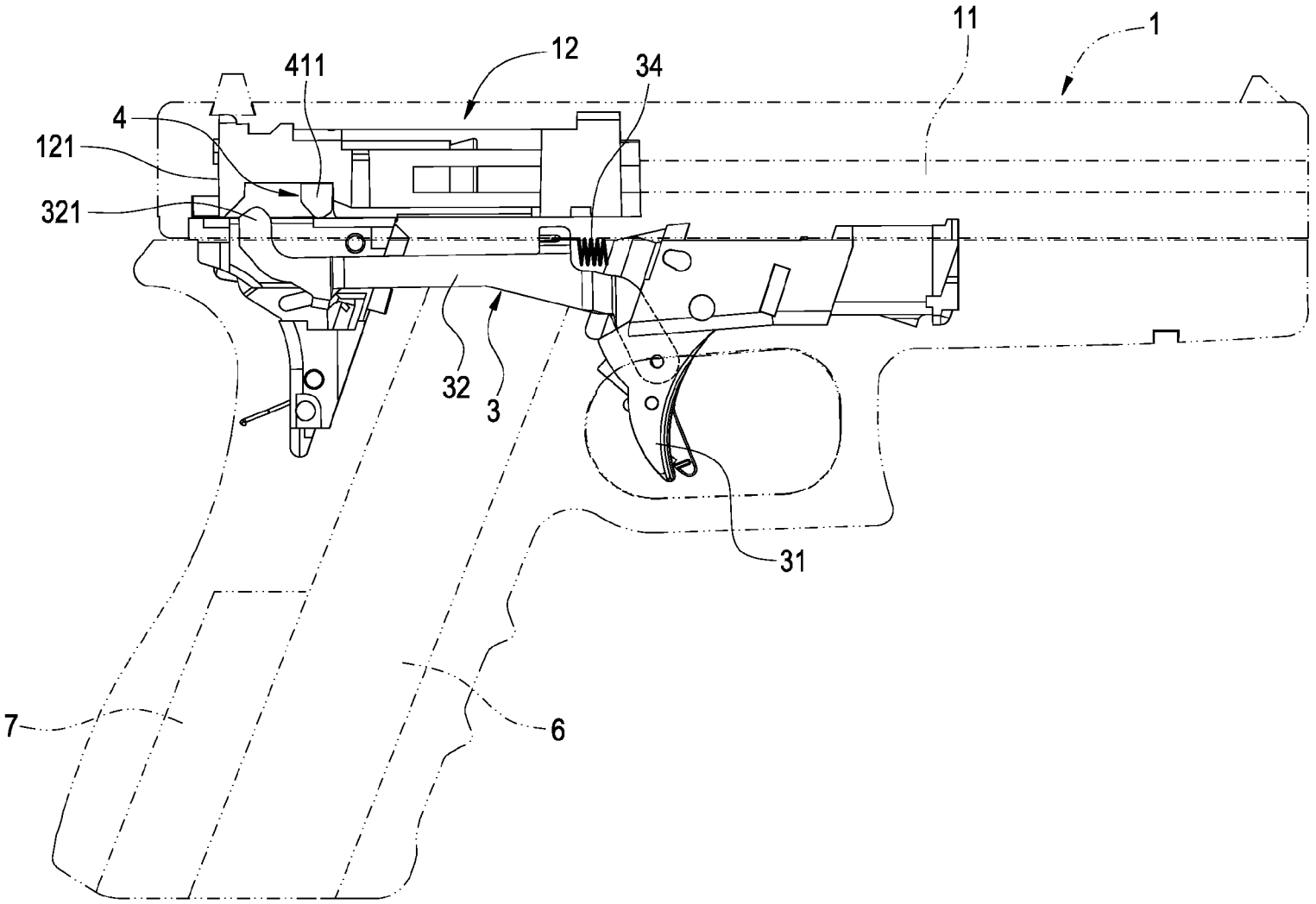
FIG. 1 is a schematic view showing the assembly of the air soft gun according to the present invention.

A preferred embodiment of the present invention will be described with reference to the drawings.

Please refer from FIG. 1 to FIG. 11, the present invention provides a single/continuous firing air soft gun and a firing switch thereof. The single/continuous firing air soft gun mainly comprises a gun body (1), a hammer assembly (2), a trigger assembly (3) and a firing switch device (4). The firing switch comprises a piston seat (121) and the mentioned firing switch device (4).

The gun body (1) includes a barrel (11) and an ejector assembly (12) reciprocally moving in horizontal with respect to the barrel (11). The ejector assembly (12) includes the mentioned piston seat (121) and a cylinder (122) fixed on the piston seat (121) and a piston (123) sleeved in the cylinder (122). The piston seat (121) is formed with a hitting part (1211).

The hammer assembly (2) is fixed in the gun body (1), and includes a hammer (21) striking corresponding to the piston seat (121), a latch piece (22) moveably engaging with the hammer (21), and the latch piece (22) is protrudingly formed with a releasing part (221).

The trigger assembly (3) is pivoted in the gun body (1) and capable of moveably latching the hammer (21); detailed illustration as following: the trigger assembly (3) includes a trigger (31), a link pin (32), a sear (33) and a spring (34), two ends of the link pin (32) are respectively connected to the trigger (31) and the sear (33), so the trigger (31) is enabled to link the sear (33) through the link pin (32), thereby allowing the sear (33) to moveably latch the hammer (21). Wherein, the link pin (32) is extended with a protrusion (321), the spring (34) is elastically clamped between the link pin (32) and the gun body (1).

The firing switch device (4) is installed on the piston seat (121), and includes a main body (41) and a positioning unit (42). The main body (41) includes a stop piece (411) and a toggle piece (412) connected with the stop piece (411), and the stop piece (411) is disposed corresponding to the trigger assembly (3), detailed illustration as following: the stop piece (411) is disposed corresponding to the protrusion (321), and the main body (41) is extended with the stop piece (411) in a direction away from the piston seat (121), the stop piece (411) is formed with a notch (413), and the toggle piece (412) is formed at one side of the stop piece (411) and corresponding to the notch (413), and the main body (41) is further formed with plural recessed slots (414); the positioning unit (42) includes a lock pin (421) and an elastic member (422), the elastic member (422) is elastically clamped between the lock pin (421) and the piston seat (121), and the lock pin (421) is selectively latched in one of the recessed slots (414).

Figure 2:
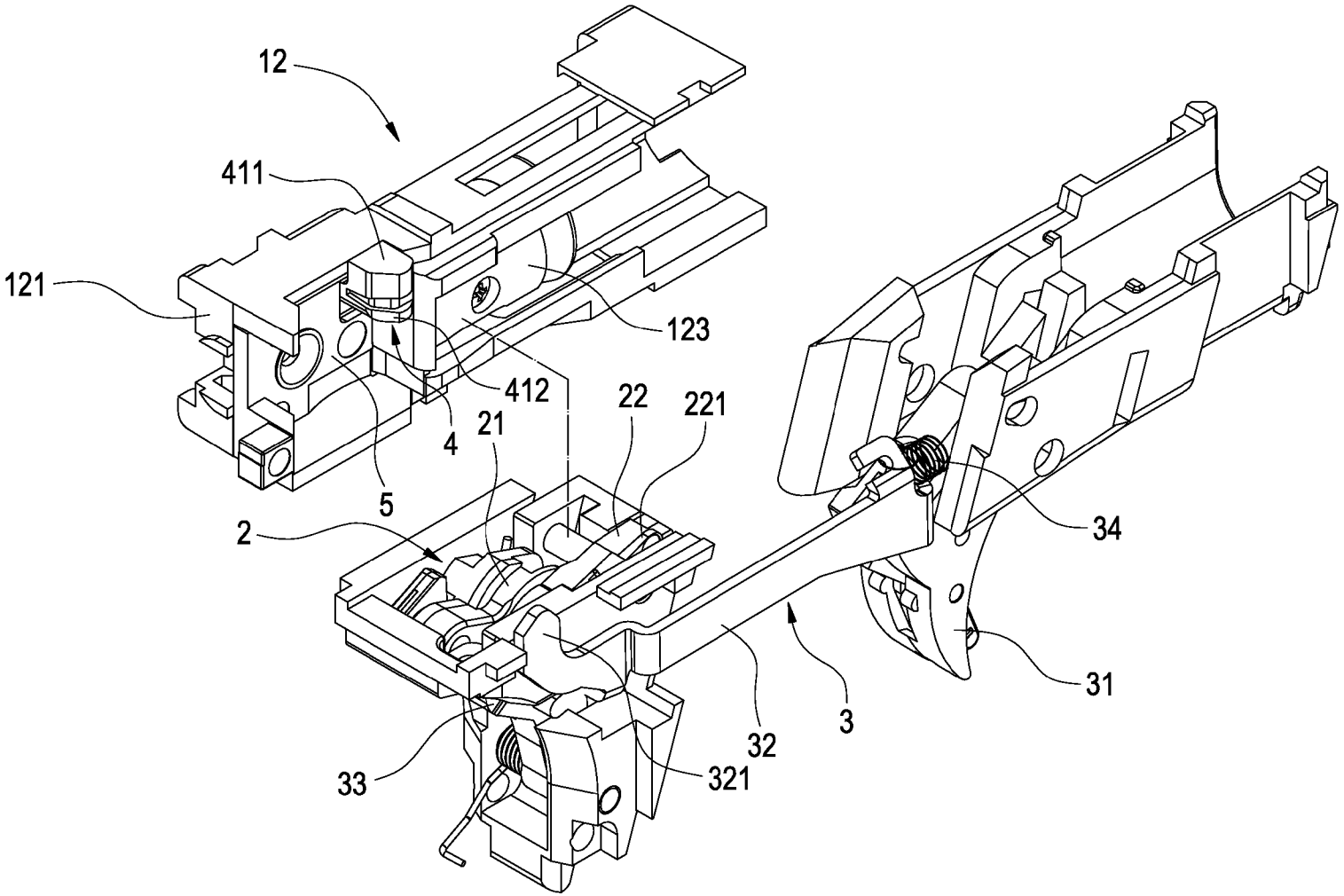
FIG. 2 is a perspective exploded view showing the air soft gun according to the present invention.

Wherein, as shown in FIG. 2, firstly the hitting part (1211) downwardly presses the hammer (21) thereby allowing the latch piece (22) to latch the hammer (21), then the hitting part (1211) presses the releasing part (221) thereby allowing the latch piece (22) to release the hammer (21), and single firing is therefore formed. As such, when the toggle piece (412) is moved towards a direction, the stop piece (411) drives the trigger assembly (3) to be latched with the hammer (21), detailed illustration as following: the stop piece (411) presses the protrusion (321) for linking the trigger (31) and the sear (33) to be recovered, so the sear (33) and the hammer (21) are mutually latched, thereby forming the disclosed single firing; on the other hand, when the toggle piece (412) is moved towards another direction, the stop piece (411) and the protrusion (321) are staggered, thereby causing the sear (33) and the hammer (21) to be separated, and continuous firing is therefore formed.

According to the present invention, the single/continuous firing air soft gun further includes a restrain seat (5) fixed on the piston seat (121), and the main body (41) is displaceably clamped between the piston seat (121) and the restrain seat (5).

According to the present invention, the single/continuous firing air soft gun further includes a magazine (6) and an air supply assembly (7) installed in the gun body (1), and when the hammer (21) strikes the piston seat (121), the magazine (6), the air supply assembly (7) and the cylinder (122) are enabled to be in communication with each other.

Figure 3:
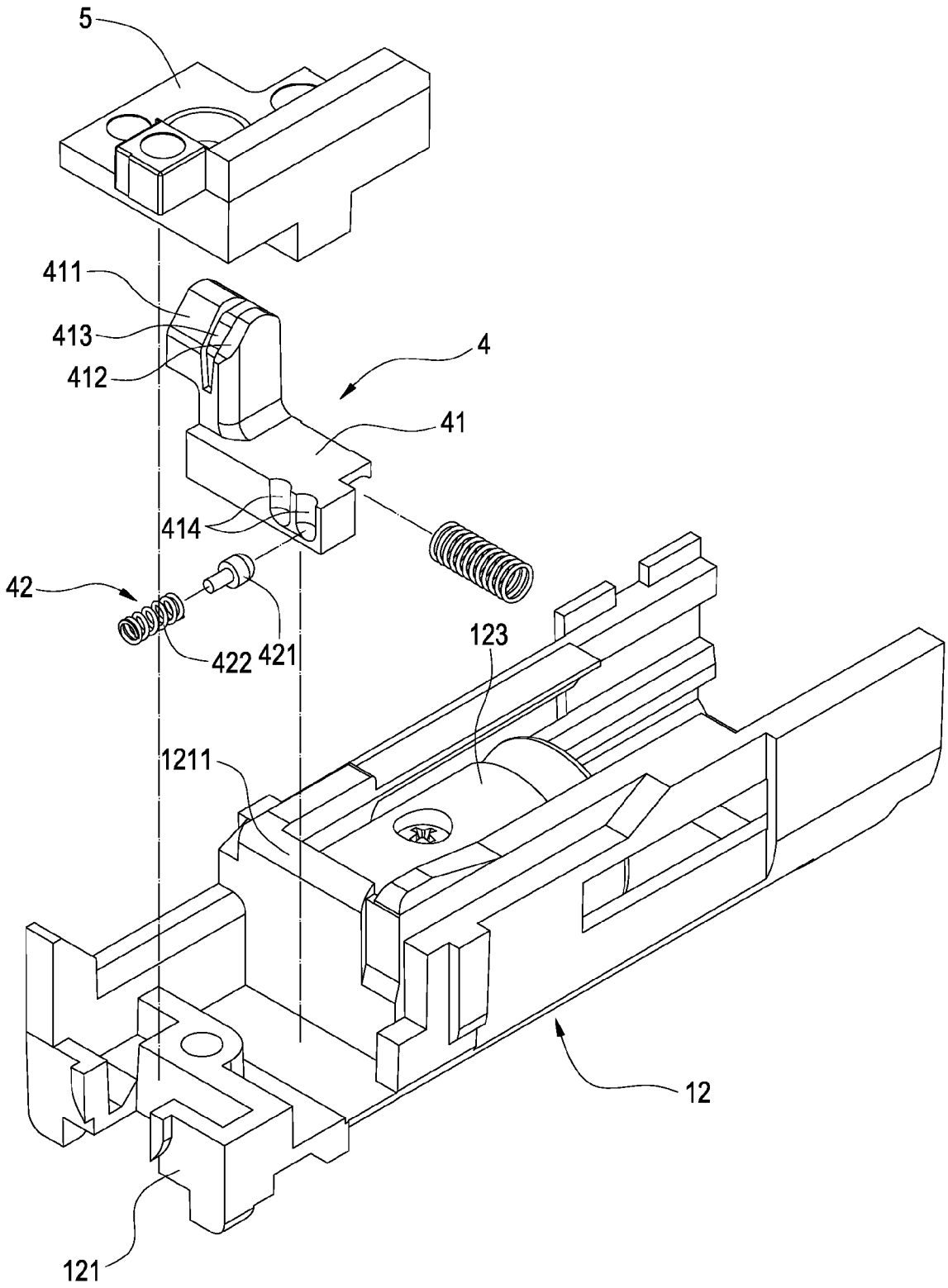
FIG. 3 is a perspective exploded view showing the firing switch according to the present invention.

As shown from FIG. 1 to FIG. 3, which disclose the assembly of the single/continuous firing air soft gun provided by the present invention, the interior of the gun body (1) includes the barrel (11) and the ejector assembly (12) reciprocally moving in horizontal with respect to the barrel (11), and the ejector assembly (12) includes the piston seat (121); the hammer assembly (2) is fixed in the gun body (1), and includes the hammer (21) striking corresponding to the piston seat (121); the trigger assembly (3) is pivoted in the gun body (1) and capable of moveably latching the hammer (21); the firing switch device (4) is installed on the piston seat (121), and includes the stop piece (411) and the toggle piece (412) connected with the stop piece (411), and the stop piece (411) is disposed corresponding to the trigger assembly (3); wherein, when the toggle piece (412) is moved towards a direction, the stop piece (411) drives the trigger assembly (3) to be latched with the hammer (21), thereby forming the single firing; on the other hand, when trigger assembly (3) and the hammer (21) are separated, the continuous firing is formed. In addition, the assembly of the firing switch provided by the present invention is disclosed, and the piston seat (121) is disposed in the gun body (1) and capable of reciprocally moving in horizontal with respect to the barrel (11); the firing switch device (4) is installed on the piston seat (121), and includes the stop piece (411) and the toggle piece (412) connected with the stop piece (411), and the stop piece (411) is disposed corresponding to the trigger assembly (3). Accordingly, the toggle piece (412) is installed on the piston seat (121), so the toggle piece (412) is hidden inside the gun body (1) instead of being exposed outside the gun body (1), thereby enabling to the firing switch device (4) to be prevented from being accidentally touched by the user, so the operation safety of air soft gun is enhanced. Meanwhile, the firing switch device (4) provided by the present invention is applicable in various types of gun bodies (1), and not restrained by the contour of the gun body (1), thereby achieving the advantages of lowering production cost and simplifying assembly.

Moreover, the stop piece (411) is formed with the notch (413), and the toggle piece (412) is formed at one side of the stop piece (411) and corresponding to the notch (413), so the toggle piece (412) is easier to be moved through the notch (413), thereby simplifying the components of the firing switch device (4), so the firing switch device (4) of the present invention is provided with the advantages of simplifying assembled components, lowering production cost and easy in assembly.

Figure 4:
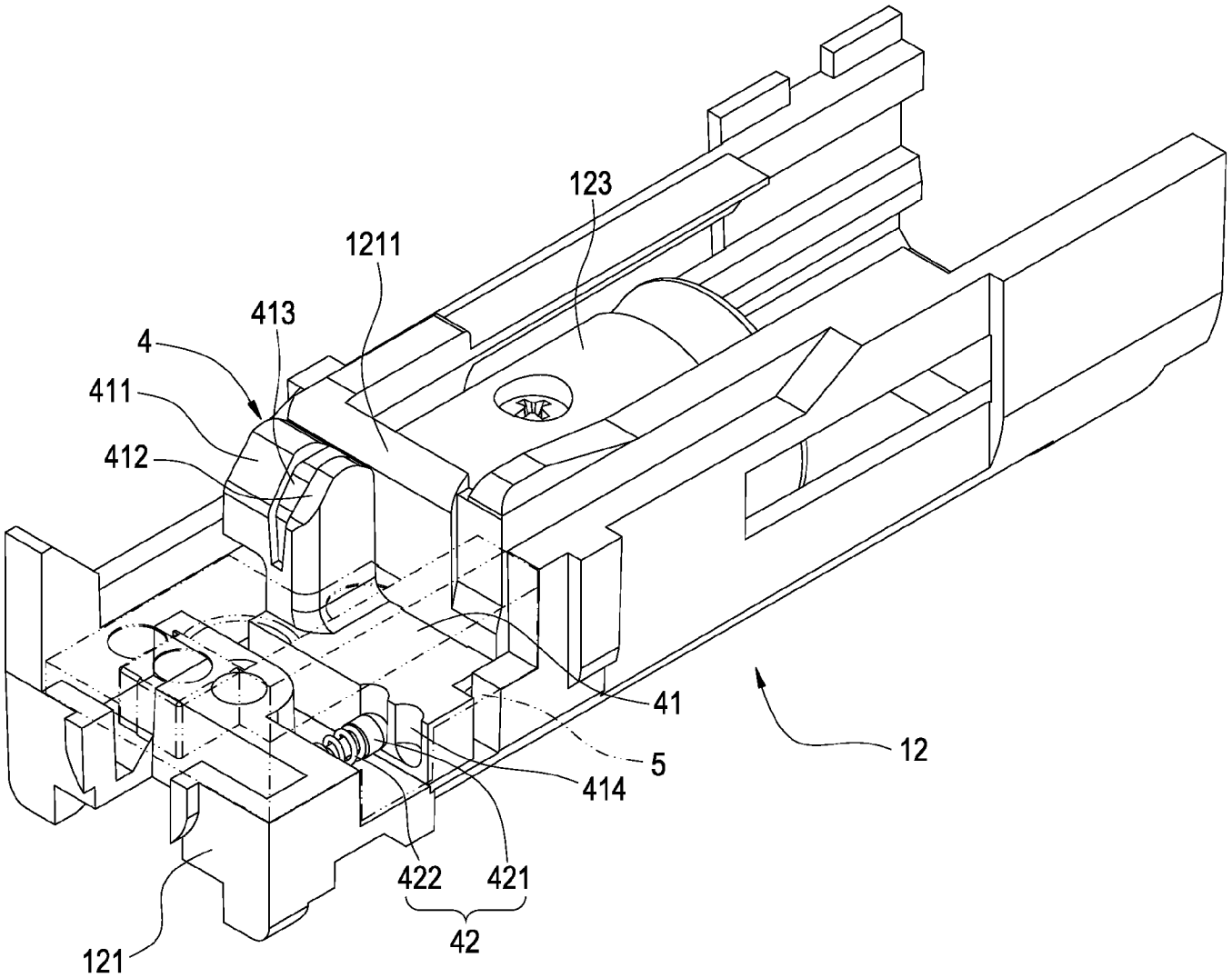
FIG. 4 is a schematic view illustrating the firing switch being in a first operation state according to the present invention.
Figure 5:
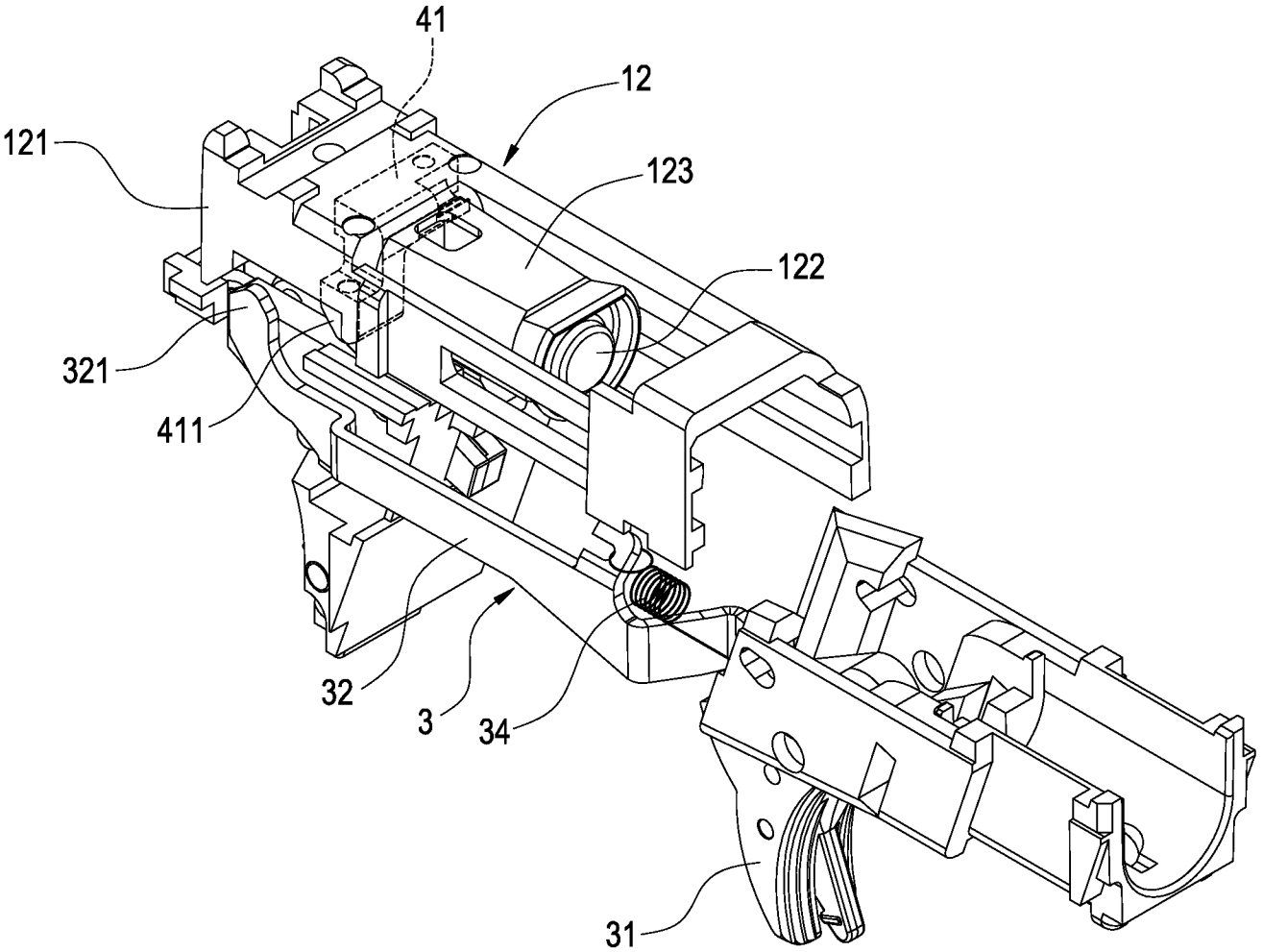
FIG. 5 is a schematic view illustrating the air soft gun being in a first operation state according to the present invention.
Figure 6:
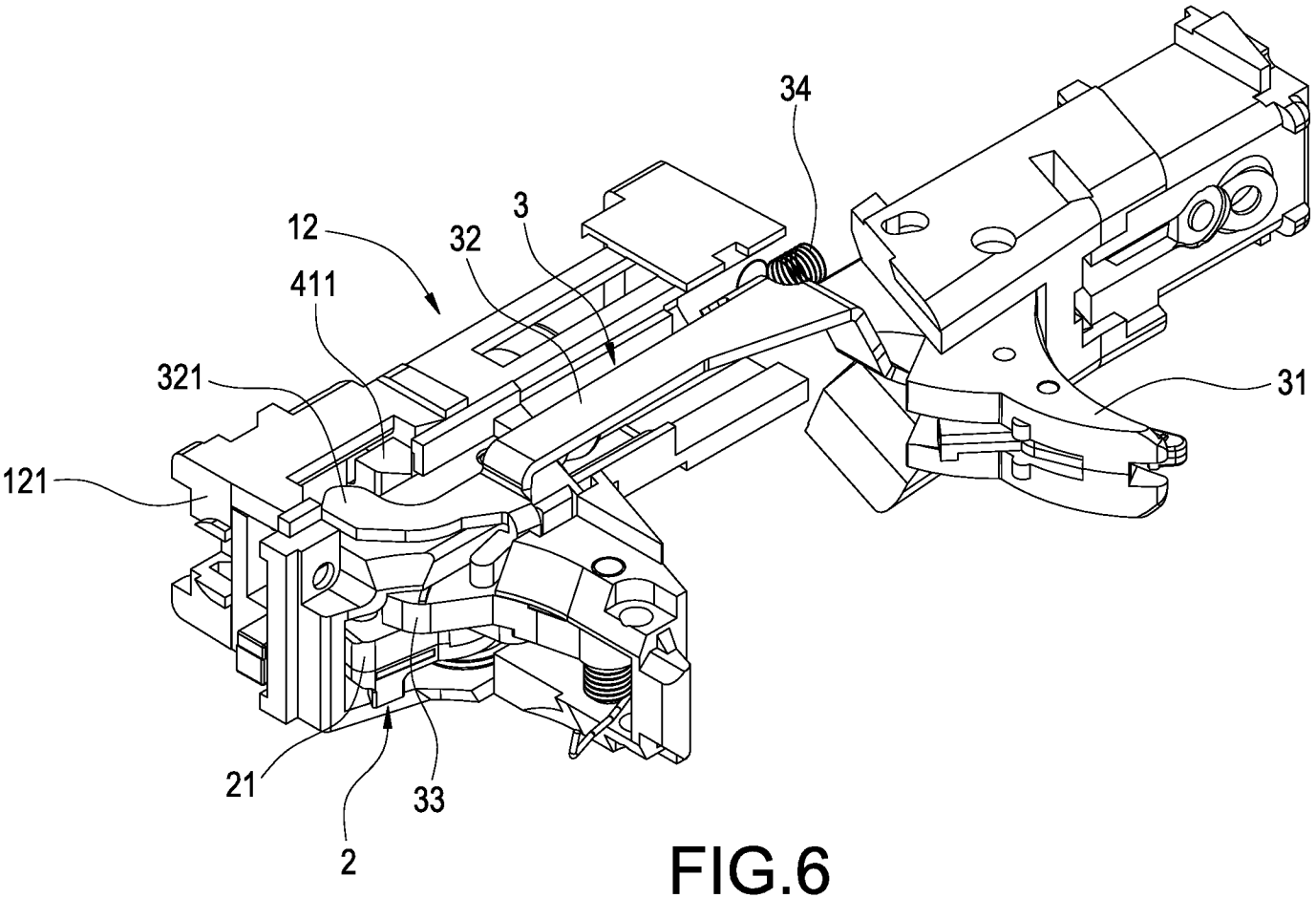
FIG. 6 is a schematic view illustrating the air soft gun being in another first operation state according to the present invention.
Figure 7:
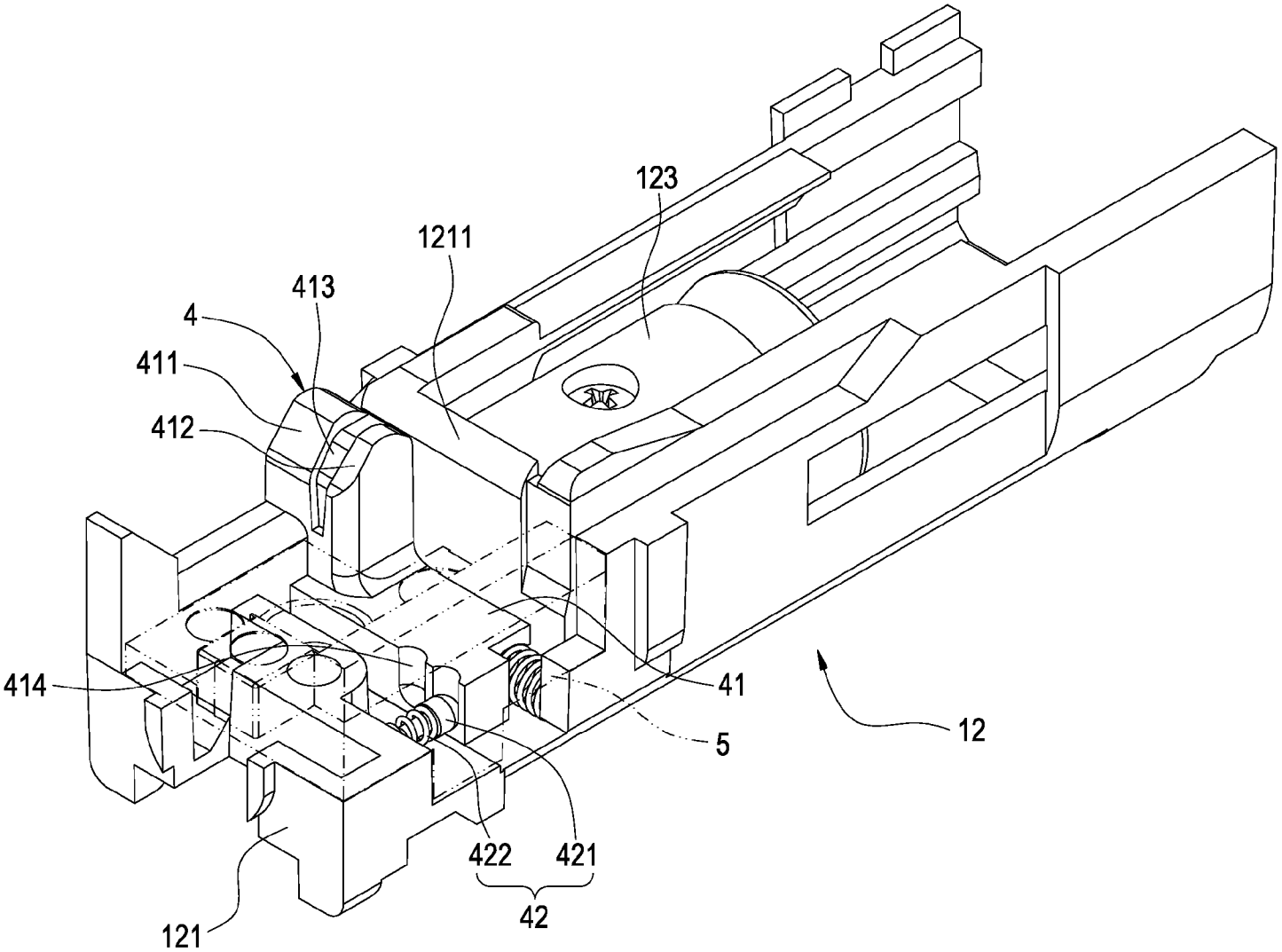
FIG. 7 is a schematic view illustrating the firing switch being in a second operation state according to the present invention.
Figure 8:
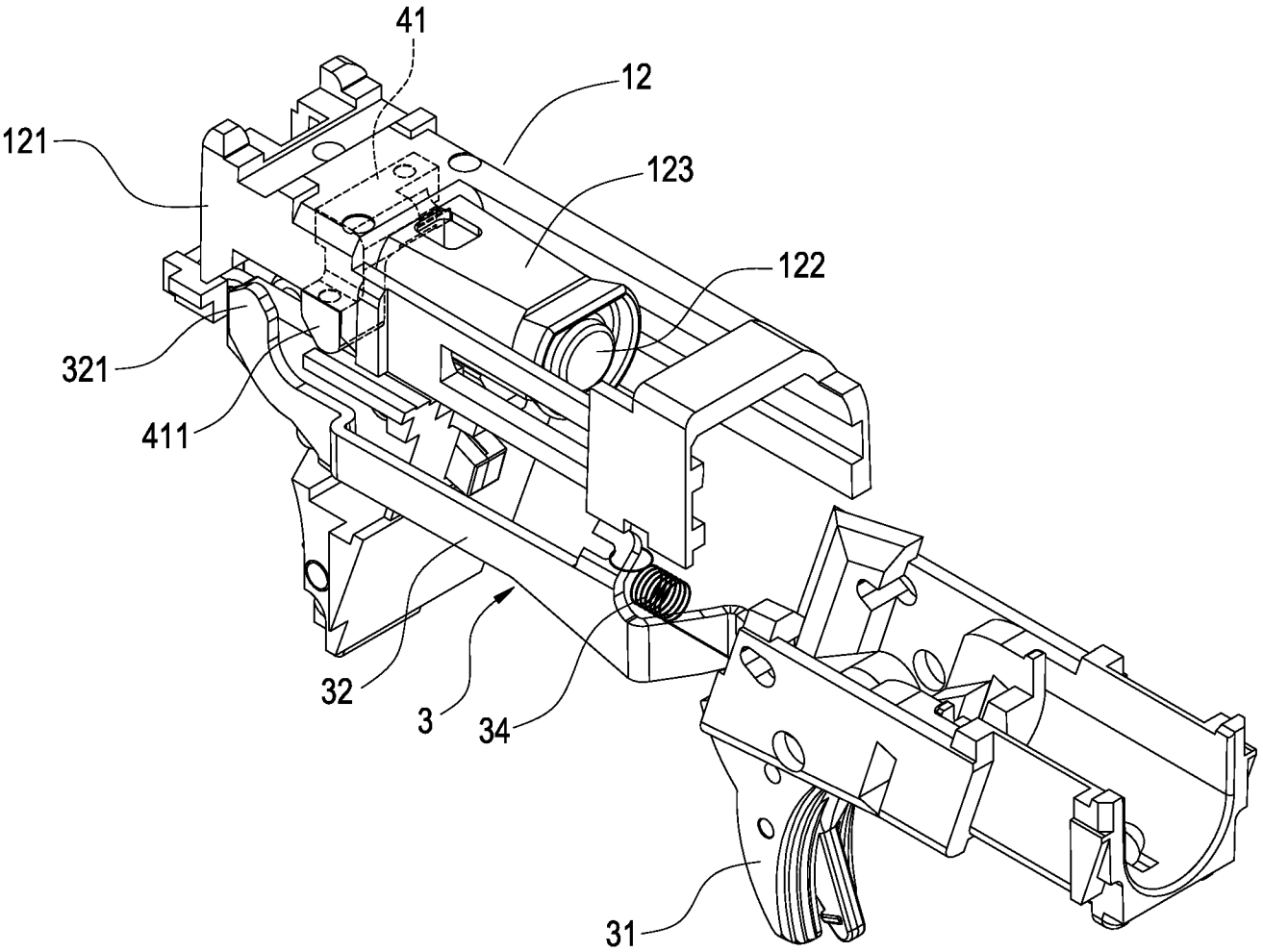
FIG. 8 is a schematic view illustrating the air soft gun being in a second operation state according to the present invention.
Figure 9:
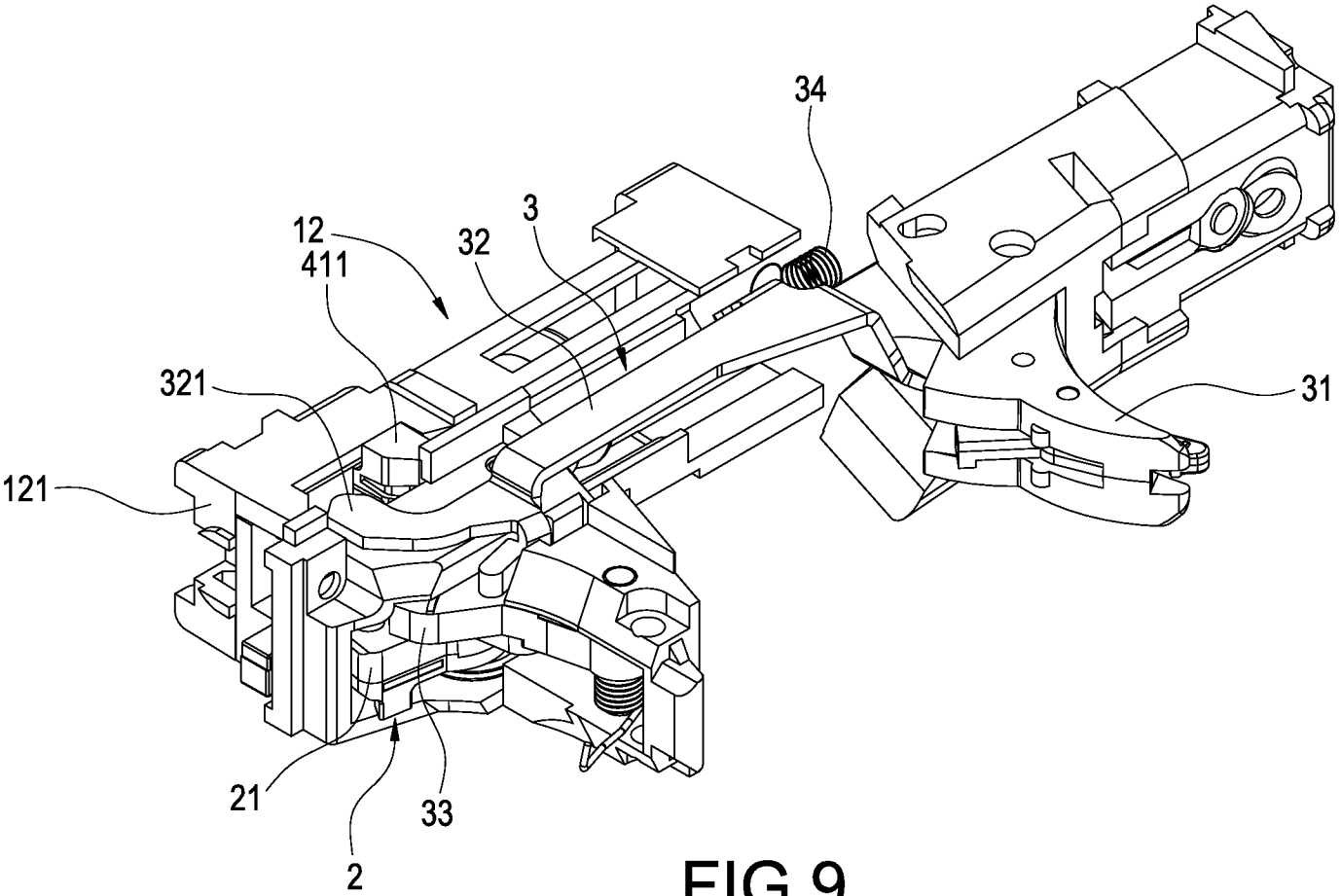
FIG. 9 is a schematic view illustrating the air soft gun being in another second operation state according to the present invention.
Figure 10:
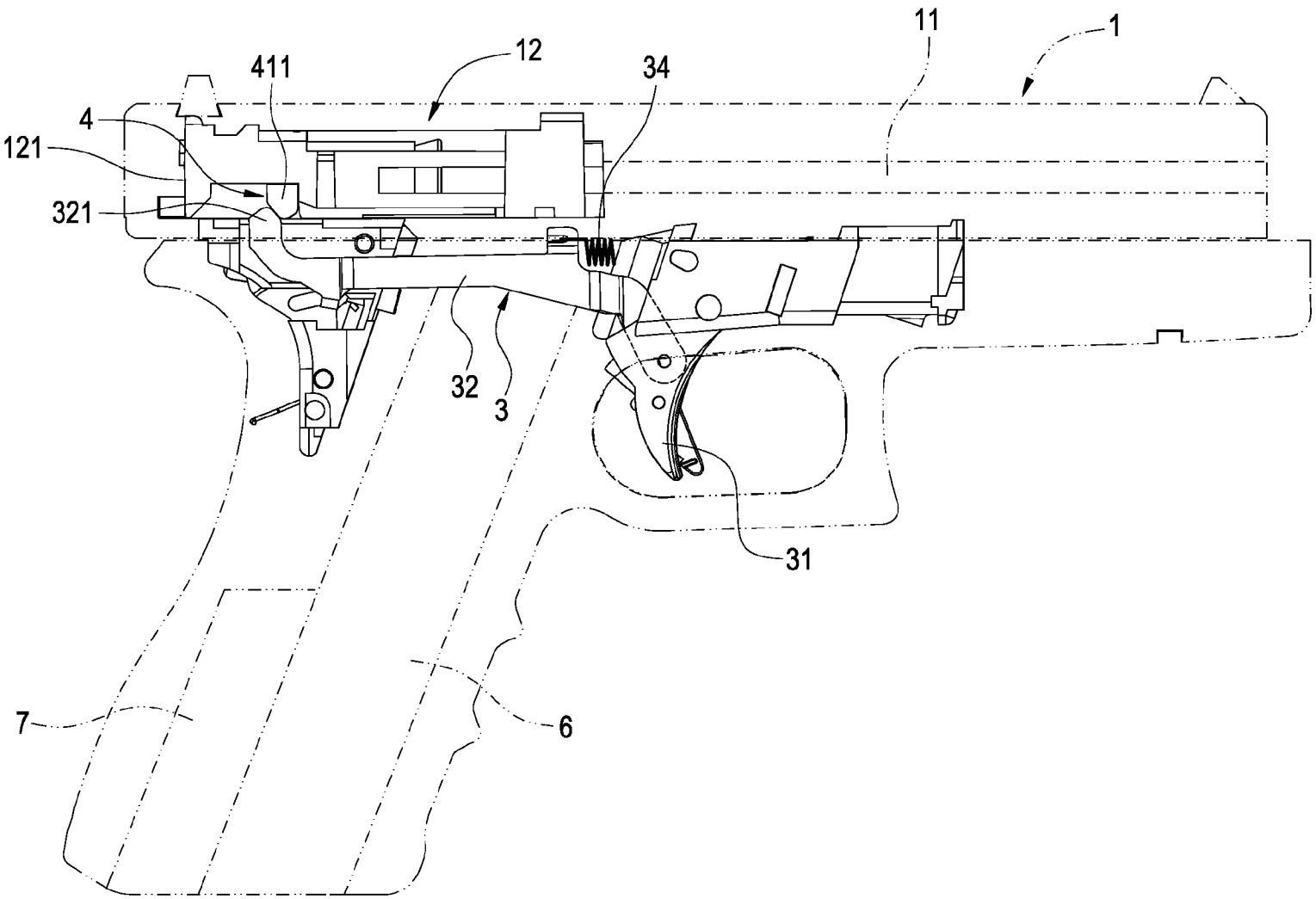
FIG. 10 is a schematic view illustrating the air soft gun being in one another second operation state according to the present invention.
Figure 11:
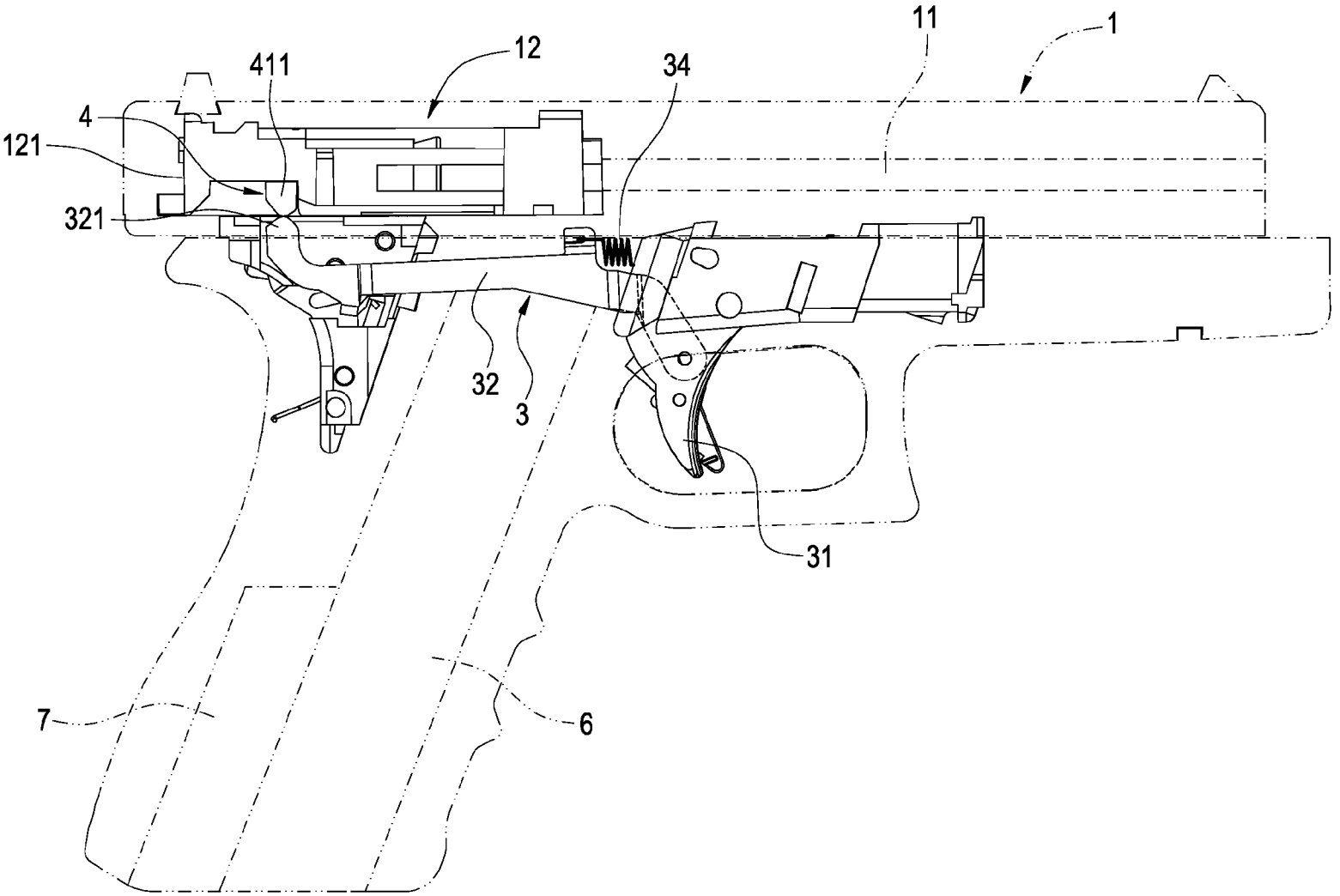
FIG. 11 is a schematic view illustrating the air soft gun being in still another second operation state according to the present invention.

As shown from FIG. 4 to FIG. 6, which are schematic views illustrating the air soft gun and the firing switch thereof being in a first operation state according to the present invention, the disclosed state is continuous firing; please refer to FIG. 2, wherein when the toggle piece (412) is moved towards the continuous firing direction, the stop piece (411) and the protrusion (321) are staggered, thereby causing the sear (33) and the hammer (21) to be separated, so after the first firing, the piston (123) is subject to an impact force thereby driving the piston seat (121) to reciprocally move, and the hitting part (1211) downwardly presses the hammer (21), thereby allowing the latch piece (22) to latch the hammer (21), then the hitting part (1211) presses the releasing part (221) thereby allowing the latch piece (22) to release the hammer (21), and the disclosed action is repeatedly performed for forming the continuous firing.

As shown from FIG. 7 to FIG. 11, which are schematic views illustrating the air soft gun and the firing switch thereof being in a second operation state according to the present invention, the disclosed state is single firing; please refer to FIG. 2, wherein when the toggle piece (412) is moved towards the single firing direction, the stop piece (411) presses the protrusion (321) for linking the trigger (31) and the sear (33) to be recovered, so the sear (33) and the hammer (21) are mutually latched, after the first firing, the piston (123) is subject to an impact force thereby driving the piston seat (121) to reciprocally move, and because the hammer (21) is latched by the sear (33), the hitting part (1211) presses the releasing part (221), and the latch piece (22) releases the hammer (21) but the sear (33) does not release the hammer (21), thereby forming the single firing.

As what has been disclosed above, the single/continuous firing air soft gun and the firing switch thereof provided by the present invention can achieve the anticipated effects and capable of solving the disadvantages of related art; accordingly, the present invention has complied with the element of novelty and non-obviousness.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A single/continuous firing air gun comprising:

a gun body (1), including a barrel (11) and an ejector assembly (12) reciprocally moving in horizontal with respect to the barrel (11), the ejector assembly (12) including a piston seat (121);

a hammer assembly (2), fixed in the gun body (1), and including a hammer (21) striking corresponding to the piston seat (121);

a trigger assembly (3), pivoted in the gun body (1) and capable of moveably latching the hammer (21); and a firing switch device (4), installed on the piston seat (121), and including a stop piece (411) and a toggle piece (412) connected with the stop piece (411), the stop piece (411) being disposed corresponding to the trigger assembly (3);

wherein, when the toggle piece (412) is moved towards a direction, the stop piece (411) drives the trigger assembly (3) to be latched with the hammer (21), thereby forming the single firing; on the other hand, when the trigger assembly (3) and the hammer (21) are separated, the continuous firing is formed.

2. The single/continuous firing air gun according to claim 1, further including a restrain seat (5) fixed on the piston seat (121), the main body (41) being displaceably clamped between the piston seat (121) and the restrain seat (5).

3. The single/continuous firing air gun according to claim 1, wherein the firing switch device (4) includes a main body (41), the main body (41) is extended with the stop piece (411) in a direction away from the piston seat (121), the stop piece (411) is formed with a notch (413), and the toggle piece (412) is formed at one side of the stop piece (411) and corresponding to the notch (413).

4. The single/continuous firing air gun according to claim 1, wherein the firing switch device (4) includes a main body (41), the main body (41) is formed with plural recessed slots (414), the firing switch device (4) further includes a positioning unit (42), the positioning unit (42) includes a lock pin (421) and an elastic member (422), the elastic member (422) is elastically clamped between the lock pin (421) and the piston seat (121), and the lock pin (421) is selectively latched in one of the recessed slots (414).

5. The single/continuous firing air gun according to claim 1, wherein the trigger assembly (3) includes a trigger (31), a link pin (32), a sear (33) and a spring (34), two ends of the link pin (32) are respectively connected to the trigger (31) and the sear (33), and the spring (34) is elastically clamped between the link pin (32) and the gun body (1).

6. The single/continuous firing air gun according to claim 5, wherein the trigger (31) links the sear (33) through the link pin (32), thereby allowing the sear (33) to moveably latch the hammer (21).

7. The single/continuous firing air gun according to claim 6, wherein the link pin (32) is extended with a protrusion (321), and the stop piece (411) presses the protrusion (321) for linking the trigger (31) and the sear (33) to be recovered, so the sear (33) and the hammer (21) are mutually latched.

8. The single/continuous firing air gun according to claim 1, further including a magazine (6) and an air supply assembly (7) installed in the gun body (1), wherein the ejector assembly (12) further includes a cylinder (122) fixed on the piston seat (121) and a piston (123) sleeved in the cylinder (122), and when the hammer (21) strikes the piston seat (121), the magazine (6), the air supply assembly (7) and the cylinder (122) are enabled to be in communication with each other.

9. The single/continuous firing air gun according to claim 1, wherein the hammer assembly (2) further includes a latch piece (22) moveably engaging with the hammer (21), the latch piece (22) is protrudingly formed with a releasing part (221), the piston seat (121) is formed with a hitting part (1211), the hitting part (1211) downwardly presses the hammer (21) thereby allowing the latch piece (22) to latch the hammer (21), and then the hitting part (1211) presses the releasing part (221), thereby enabling the latch piece (22) to release the hammer (21).

* * * * *